US010359724B2

(12) United States Patent
Yasuda et al.

(10) Patent No.: US 10,359,724 B2
(45) Date of Patent: Jul. 23, 2019

(54) PRINTER AND COMPUTER READABLE MEMORY

(71) Applicant: BROTHER KOGYO KABUSHIKI KAISHA, Nagoya-shi, Aichi-ken (JP)

(72) Inventors: Masaki Yasuda, Nagoya (JP); Takashi Suzuki, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/286,721

(22) Filed: Oct. 6, 2016

(65) Prior Publication Data

US 2017/0102657 A1 Apr. 13, 2017

(30) Foreign Application Priority Data

Oct. 8, 2015 (JP) ..... 2015-200501

(51) Int. Cl.
*B65H 1/00* (2006.01)
*B65H 1/04* (2006.01)
(Continued)

(52) U.S. Cl.
CPC ..... *G03G 15/50* (2013.01); *B65H 1/00* (2013.01); *B65H 1/04* (2013.01); *B65H 1/14* (2013.01); *B65H 1/266* (2013.01); *G03G 15/6502* (2013.01); *B65H 2511/30* (2013.01); *B65H 2511/33* (2013.01)

(58) Field of Classification Search
CPC ..... G03G 15/50; G03G 15/6502; B65H 2511/33; B65H 1/266; B65H 1/14; B65H 2511/30; B65H 1/04; B65H 1/00
See application file for complete search history.

(56) References Cited

U.S. PATENT DOCUMENTS 5,100,122 A * 3/1992 Noda ..... B65H 1/04 271/127
2011/0233846 A1 9/2011 Miwa
(Continued)

FOREIGN PATENT DOCUMENTS

JP 10-265084 A 10/1998
JP 10-338370 A 12/1998
(Continued)

*Primary Examiner* — David H Banh
(74) *Attorney, Agent, or Firm* — Merchant & Gould P.C.

(57) ABSTRACT

A printer includes a casing, a print mechanism disposed inside the casing, and a motor. A sheet cassette has an attached position in which the sheet cassette is supported by the casing and a separated position in which the sheet cassette is at least partially separated from the casing. The sheet cassette includes a movable sheet support plate configured to support a sheet stack including one or more sheets. An actuator, such as a clutch, has a transmission mode in which the drive force is allowed to be transmitted from the motor to the sheet support plate to move the sheet support plate, and an interruption mode in which the drive force is prevented from being transmitted from the motor to the sheet support plate. The actuator is configured to be selectively placed in one of the transmission mode and the interruption mode. A controller is configured to selectively place the actuator into the transmission mode and the interruption mode.

24 Claims, 12 Drawing Sheets

(51) Int. Cl.

| | |
|---|---|
| ***B65H 1/14*** | (2006.01) |
| ***B65H 1/26*** | (2006.01) |
| ***G03G 15/00*** | (2006.01) |

(56) References Cited

U.S. PATENT DOCUMENTS

| | | | | |
|---|---|---|---|---|
| 2013/0134657 | A1* | 5/2013 | Nishioka | B65H 1/14<br>271/147 |
| 2013/0193636 | A1* | 8/2013 | Udagawa | B65H 1/266<br>271/162 |
| 2015/0353302 | A1* | 12/2015 | Nishioka | B65H 1/266<br>271/160 |

FOREIGN PATENT DOCUMENTS

| | | | |
|---|---|---|---|
| JP | 2001-097569 | A | 4/2001 |
| JP | 2002-274696 | A | 9/2002 |
| JP | 2005-343670 | A | 12/2005 |
| JP | 2007-269462 | | 10/2007 |
| JP | 5189125 | A | 4/2013 |

* cited by examiner

PRINTER AND COMPUTER READABLE MEMORY

CROSS-REFERENCE TO RELATED APPLICATION

This application claims priority from Japanese Patent Application No. 2015-200501 filed on Oct. 8, 2015, the content of which is incorporated herein by reference in its entirety.

FIELD OF DISCLOSURE

The disclosure relates to a printer including a sheet cassette with a sheet support plate and a computer readable memory storing program instructions that implement a method including calculating an amount of sheets stacked on the sheet support plate.

BACKGROUND

A known printer includes a sheet cassette that includes a sheet support plate configured to movably support a stack of one or more sheets in an up-down direction, and a raising gear configured to raise the sheet support plate. The printer further includes a driving gear configured to be driven by a motor. With the sheet cassette mounted in or attached to a casing of the printer, the driving gear and the raising gear are coupled to or engaged with each other to allow drive force from the motor to be supplied to the sheet support plate. The sheet support plate is raised by the drive force to a sheet feedable position where a sheet on the sheet support plate is allowed to be fed.

The printer estimates an amount of sheets stacked on the sheet support plate by measuring a period of time for the sheet support plate to reach the sheet feedable position from the lowest position.

With the sheet cassette attached to the casing, the driving gear is engaged with the raising gear, which enables the sheet support plate to be held in a raised position even if the motor is stopped. With the sheet cassette separated from the casing, the driving gear and the raising gear are disengaged from each other, which allows the sheet support plate to be lowered by its own weight to the lowest positon.

Engaging the raising gear with the driving gear may cause rotation of the raising gear relative to the driving gear. This rotation may cause the sheet support plate at the lowest position to be raised.

SUMMARY

One or more aspect of the disclosure relates to a printer that may enable a sheet support plate to be lowered to a lowered position after the sheet cassette has been mounted in a casing. A disclosed example of a printer includes a casing, a print mechanism disposed inside the casing, and a motor. A sheet cassette has an attached position in which the sheet cassette is supported by the casing and a separated position in which the sheet cassette is at least partially separated from the casing. The sheet cassette includes a movable sheet support plate configured to support a sheet stack including one or more sheets. An actuator, such as a clutch, has a transmission mode in which the drive force is allowed to be transmitted from the motor to the sheet support plate to move the sheet support plate, and an interruption mode in which the drive force is prevented from being transmitted from the motor to the sheet support plate. The actuator is configured to be selectively placed in one of the transmission mode and the interruption mode. A controller is configured to selectively place the actuator into the transmission mode and the interruption mode.

One or more aspect of the disclosure relates to a computer readable memory storing program instructions that implement a method including calculating an amount of sheets stacked on a sheet support plate. The program instructions implement the method further including receiving a cassette sensor signal indicating a sheet cassette has been attached to a printer. The program instructions implement the method further including placing an actuator in an interruption mode in which a drive force is prevented from being transmitted from a motor to a sheet support plate in response to the received cassette sensor signal. The program instructions implement the method further including placing the actuator in a transmission mode in which the drive force is allowed to be transmitted from the motor to the sheet support plate to move the sheet support plate. The program instructions implement the method further including calculating an amount of sheets stacked on the sheet support plate based on an operation parameter of the motor in response to receiving a sheet signal from a sheet sensor.

DETAILED DESCRIPTION

An illustrative embodiment according to one or more aspects of the disclosure are described in detail with reference to the accompanying drawings.

[General Configuration of Image Forming Apparatus]

Figure 1:
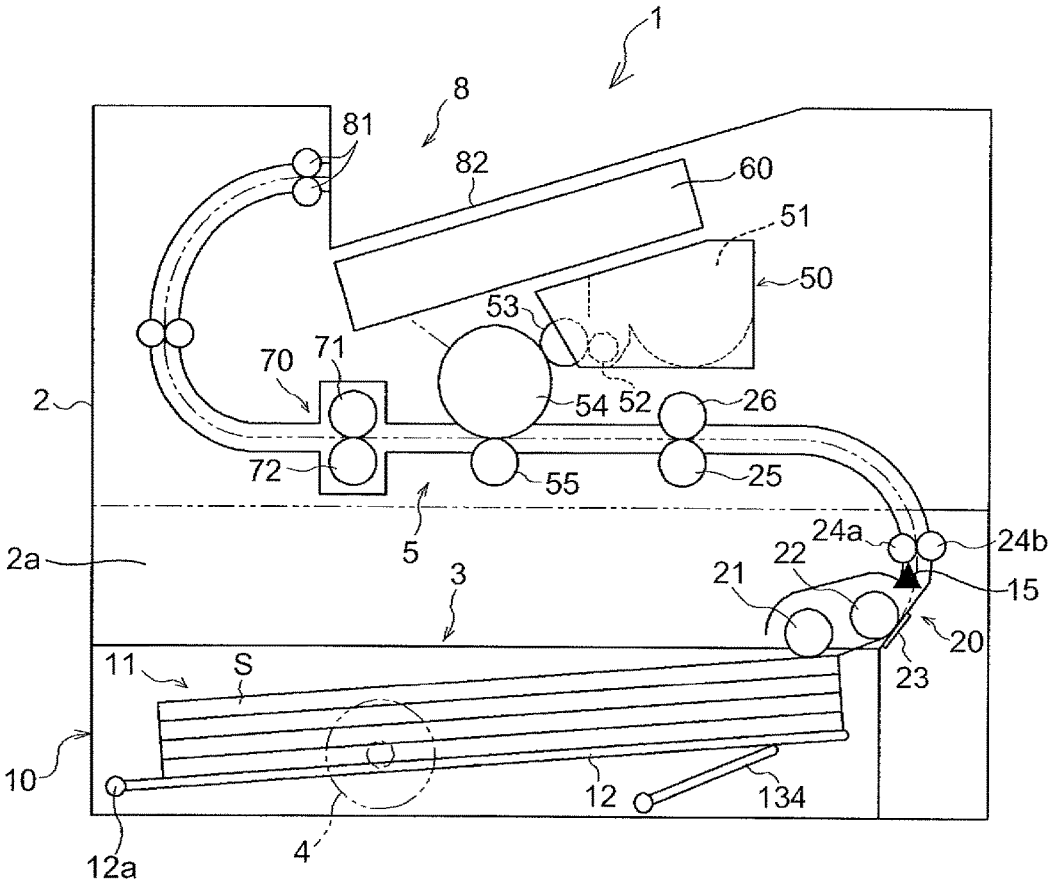
FIG. 1 is a cross-sectional view of an image forming apparatus in an illustrative embodiment according to one or more aspects of the disclosure, in which a sheet cassette is fully inserted into a sheet cassette receiving portion of a casing of the image forming apparatus.

FIG. 1 depicts an image forming apparatus 1 according to an illustrative embodiment of the disclosure. The image forming apparatus 1 includes a casing 2, a sheet supply unit 3, an image forming unit 5, a discharge unit 8, a drive source, e.g., a motor 4, configured to supply drive force, a sheet sensor 9, and a controller C.

The sheet supply unit 3 is disposed at a lower portion of the image forming apparatus 1. The sheet supply unit 3 is configured to hold a stack of one or more sheets S and convey each sheet S to the image forming unit 5. The image forming unit 5 is disposed downstream of the sheet supply unit 3 in a sheet conveying direction. The image forming unit 5 is configured to form an image on the sheet S conveyed from the sheet supply unit 3. The discharge unit 8 is disposed downstream of the image forming unit 5 in the sheet conveying direction. The discharge unit 8 is configured to discharge the sheet S having an image formed thereon by the image forming unit 5 out of the image forming apparatus 1.

Figure 9:
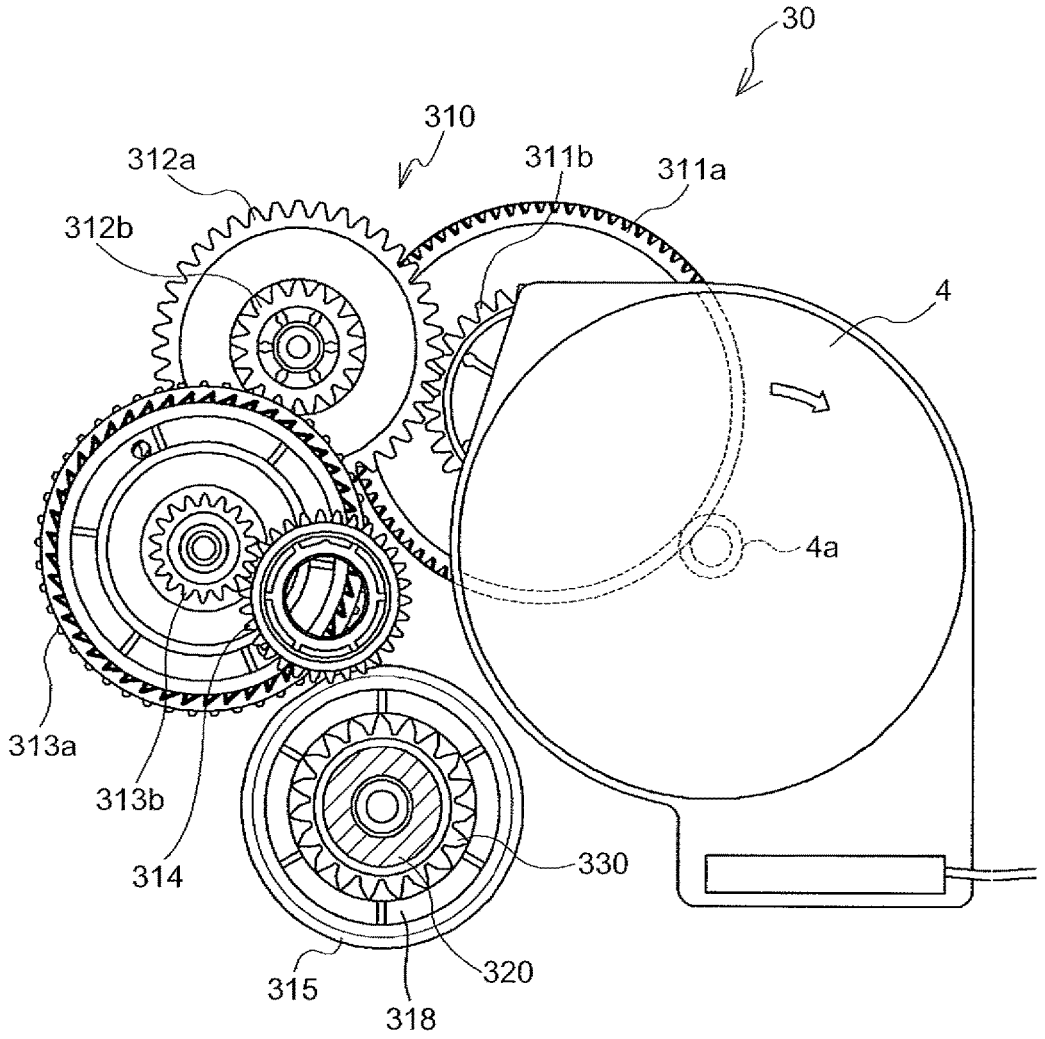
FIG. 9 depicts a side view of a drive force transmission mechanism.

The sheet supply unit 3 includes a sheet cassette 10, a feed mechanism 20, a conveying roller 24*a*, a registration roller 25, and a drive force transmission mechanism 30 (refer to FIG. 9).

The sheet cassette 10 is configured to be removably attached to a sheet cassette receiving portion 2*a* provided at a lower portion of the casing 2. In one example, the sheet cassette 10 is configured to move between an attached position and a separated position. In the attached position, the cassette 10 is fully inserted into and attached to the sheet cassette receiving portion 2*a*. In the separated position, the cassette 10 is at least partially separated from the receiving portion 2*a*.

The sheet supply unit 3 includes a cassette sensor 15 configured to detect whether the sheet cassette 10 is fully inserted into the receiving portion 2*a*.

Figure 6:
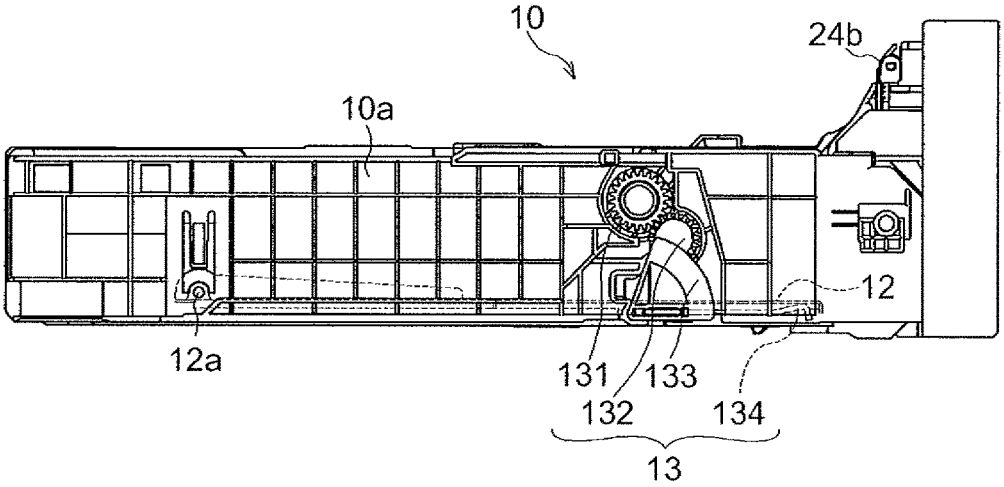
FIG. 6 is a side view of the sheet cassette.

The sheet cassette 10 includes a sheet holding portion 11, a sheet support plate, or pressure plate 12, and a pressure plate raising mechanism 13 (refer to FIG. 6). The sheet holding portion 11 is configured to hold a stack of one or more sheets S. The pressure plate 12 is disposed in the sheet holding portion 11. The pressure plate 12 is configured to support the sheet stack and to move up and down (e.g., in the up-down direction). The pressure plate raising mechanism 13 includes a pressure plate raising gear 131 configured to transmit drive force to the pressure plate 12.

The sheet cassette 10 is inserted into the receiving portion 2*a* from right to left in FIG. 1 to attach the cassette 10 to the receiving portion 2*a*. The cassette 10 is thus located at the attached position. The sheet cassette 10, which is located at the attached position, is pulled from the receiving portion 2*a* from left to right in FIG. 1. The cassette 10 is thus located at the separated position.

For example, when the sheet cassette is attached to the casing, the pressure plate raising gear may inadvertently rotate to raise the pressure plate from the lowest position. As noted above, if the pressure plate is maintained in a raised position when attached to the casing, an error or inaccuracy may result, for example, when an amount of sheets remaining in the sheet cassette is estimated.

In the following description, the left-right direction in FIG. 1 may be referred to as the insertion/removal direction of the sheet cassette 10. The left side in FIG. 1 may be referred to as the first side. The right side in FIG. 1 may be referred to as the second side.

A first end (e.g., left end in FIG. 1) of the pressure plate 12 is pivotally supported by the sheet holding portion 11. The pressure plate 12 is configured to pivot about a pivot 12*a* provided at the first end, allowing the other, second end of the pressure plate 12 to move in the up-down direction.

The pressure plate raising mechanism 13 is configured to raise or lift the pressure plate 12 when driven by the motor 4. The pressure plate raising mechanism 13 may raise the pressure plate 12, which may support a stack of sheets S, to a sheet feedable position (e.g., position depicted in FIG. 1). In the sheet feedable position, the sheet stack, if any, is in contact with a pick-up roller 21 (described below) and a sheet S is allowed to be fed from the stack.

The feed mechanism 20 is configured to separate the sheets S held in the sheet cassette 10 one by one, and to feed each sheet S toward the conveying roller 24*a*. The feed mechanism 20 includes the pick-up roller 21, a separation roller 22, and a separation pad 23.

The pick-up roller 21 is configured to pick up the sheets S on the pressure plate 12 located at the sheet feedable position. The pick-up roller 21 is disposed above the second end of the pressure plate 12. When the pressure plate 12 is raised to the sheet feedable position, the pick-up roller 21 contacts the second end of the sheet stack on the pressure plate 12 with an appropriate pressure applied thereto.

When one or more sheets S are stacked on the pressure plate 12, the pressure plate 12, which is being raised by the pressure plate raising mechanism 13, may stop at the sheet feedable position where the second end of the sheet stack contacts and is pressed against the pick-up roller 21.

When no sheet S is stacked on the pressure plate 12, the pressure plate 12, which is being raised by the pressure plate raising mechanism 13, may stop at a highest position in a movable range thereof in the up-down direction. In this configuration, the highest position in the movable range of the pressure plate 12 in the up-down direction, may be, for example, a position where the pressure plate 12 contacts and is pressed against the pick-up roller 21.

The separation roller 22 is disposed downstream of the pick-up roller 21 in the sheet conveying direction. The separation pad 23 is disposed facing the separation roller 22. The pad 23 is urged toward the separation roller 22.

The sheets S picked by the pick-up roller 21 are fed toward the separation roller 22, and separated one by one between the separation roller 22 and the separation pad 23. Each sheet S is conveyed toward the conveying roller 24*a*.

The conveying roller 24*a* is configured to apply conveying force to the sheet S. The conveying roller 24*a* is disposed downstream of the feed mechanism 20 in the sheet conveying direction. A paper dust removing roller 24*b* is disposed facing the conveying roller 24*a*. The sheet S fed from the feed mechanism 20 toward the conveying roller 24*a* is held between the rollers 24*a* and 24*b*, and conveyed toward the registration roller 25. The conveying roller 24*a* is exposed to a space of the sheet cassette receiving portion 2*a* for receiving the sheet cassette 10.

The registration roller 25 is disposed downstream of the conveying roller 24*a* in the sheet conveying direction. A pinch roller 26 is disposed facing the registration roller 25. A leading end of the sheet S being conveyed is temporarily stopped at a portion between the registration roller 25 and the pinch roller 26. After that, the registration roller 25 may convey the sheet S at a predetermined timing toward a transfer position.

The drive force transmission mechanism 30 is configured to couple to or engage with the pressure plate raising gear 131 of the pressure plate raising mechanism 13 when the sheet cassette 10 is fully inserted into the sheet cassette receiving portion 2*a*. The mechanism 30, when coupled to the pressure plate raising gear 131, is configured to transmit drive force from the motor 4 to the pressure plate raising gear 131.

Figure 2:
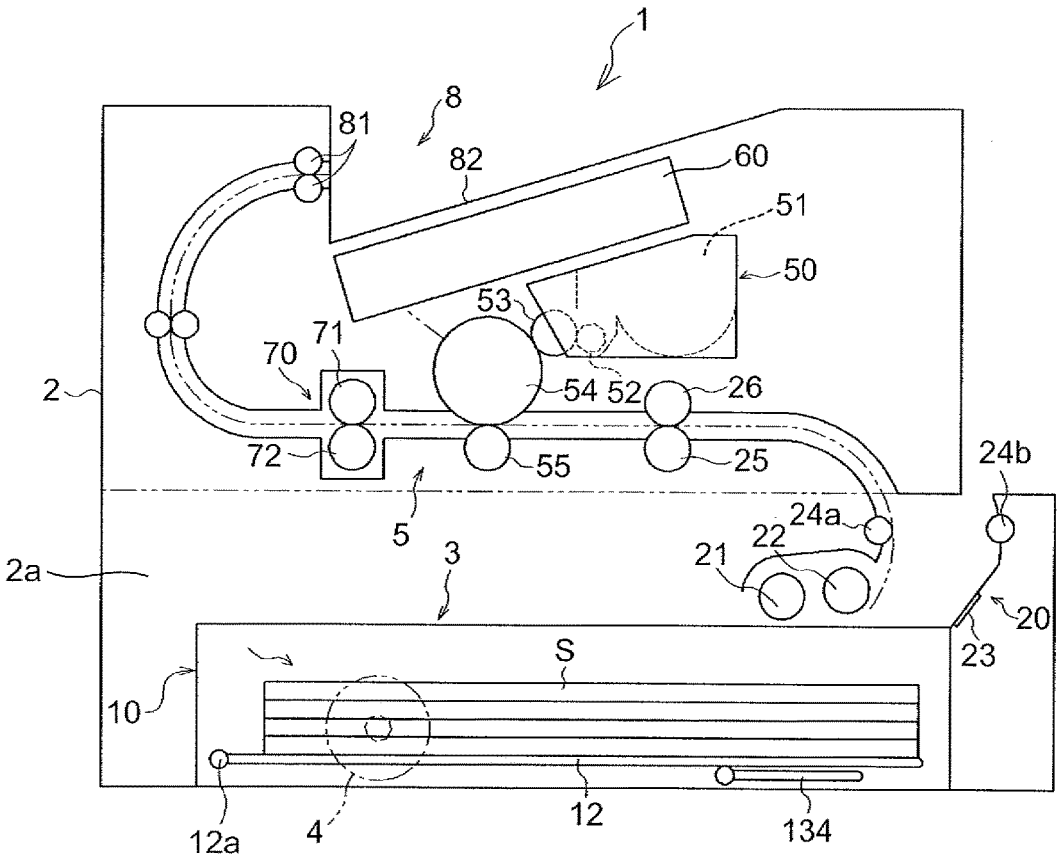
FIG. 2 is a cross-sectional view of the image forming apparatus with the sheet cassette partially separated from the sheet cassette receiving portion of the casing.

In the image forming apparatus 1, when the sheet cassette 10 is fully inserted into the sheet cassette receiving portion 2*a*, the drive force from the motor 4 is transmitted to the pressure plate raising mechanism 13 via the drive force transmission mechanism 30. This drive force transmission may cause the pressure plate 12 to rise up to the sheet feedable position where a sheet S may be fed from the stack on the pressure plate 12. When the sheet cassette 10 is not fully inserted into the sheet cassette receiving portion 2*a*, as depicted in FIG. 2, the drive force transmission mechanism 30 and the pressure plate raising mechanism 13 are disengaged from each other, which may cause the pressure plate 12 to lower, under its own weight, to the lowest position.

The image forming unit 5 includes a process cartridge 50 including a photosensitive drum 54, an exposure unit 60 and a fixing unit 70. The process cartridge 50 is configured to transfer an image to a surface of the sheet S fed from the sheet supply unit 3. The exposure unit 60 is configured to selectively expose a surface of the photosensitive drum 54 with light. The fixing unit 70 is configured to fix the image transferred by the process cartridge 50 on the sheet S.

The process cartridge 50 is disposed above the sheet cassette receiving portion 2*a* in the casing 2. The process cartridge 50 includes a developer chamber 51, a supply roller 52, a developer roller 53, the photosensitive drum 54, and a transfer roller 55.

The exposure unit 60 includes a laser diode, a polygon mirror, a lens, and a reflecting mirror. The exposure unit 60 is configured to emit laser light to the photosensitive drum 54 based on image data received by the image forming apparatus 1, to selectively expose the surface of the photosensitive drum 54.

The developer chamber 51 contains developer, e.g., toner. The toner in the developer chamber 51 is conveyed to the supply roller 52 while being agitated by an agitator (not depicted). The supply roller 52 is configured to supply the toner from the developer chamber 51 to the developer roller 53.

The developer roller 53 is disposed in contact with the supply roller 52. The developer roller 53 is configured to carry the toner, which is supplied from the supply roller 52 and is positively charged by a contact member (not depicted). A positive developing bias is applied to the developer roller 53 by a bias application device (not depicted).

The photosensitive drum 54 is disposed adjacent to the developer roller 53. The surface of the photosensitive drum 54 is uniformly and positively charged by a charger (not depicted) and then exposed to the light by the exposure unit 60. A portion of the photosensitive drum 54 exposed to the light has a lower potential than the remaining portions of the drum 54. An electrostatic latent image based on the image data is formed on the drum 54.

The positively charged toner may be supplied from the developer roller 53 to the surface of the photosensitive drum 54 having the electrostatic latent image formed thereon. The electrostatic latent image is thus developed into a developer image.

The transfer roller 55 is disposed facing the photosensitive drum 54. A negative transfer bias is applied to the transfer roller 55 by a bias application device (not depicted). With the transfer bias applied to a surface of the transfer roller 55, the sheet S being conveyed may be held at a transfer position between the transfer roller 55 and the drum 54. At the transfer position, the developer image on the surface of the photosensitive drum 54 may be transferred to a surface of the sheet S.

The fixing unit 70 includes a heat roller 71 and a pressure roller 72. The heat roller 71 is configured to be rotated by drive force from the motor 4. The heat roller 71 is configured to be heated with power supply from a power source (not depicted). The pressure roller 72 is disposed facing the heat roller 71. The pressure roller 72 is configured to be rotated by the rotation of the heat roller 71. The pressure roller 72 is in contact with the heat roller 71 when rotating. As the sheet S having the developer image transferred thereon is conveyed to the fixing unit 70, the heat roller 71 and the pressure roller 72 hold the sheet S therebetween to fix the developer image on the sheet S.

The discharge unit 8 includes discharge rollers 81 and a discharge tray 82.

The discharge rollers 81 are paired. The discharge rollers 81 are configured to discharge the sheet S conveyed from the fixing unit 70 out of the casing 2.

The discharge tray 82 is provided at an upper surface of the casing 2. The discharge tray 82 is configured to receive the sheet S discharged by the discharge rollers 81 out of the casing 2.

The sheet sensor 9 is configured to detect a sheet S when the pressure plate 12 is raised to the sheet feedable position in which a sheet S may be fed from the sheet stack on the pressure plate 12. The sheet sensor 9 may be, for example, a contact-type sensor.

Figure 3A:
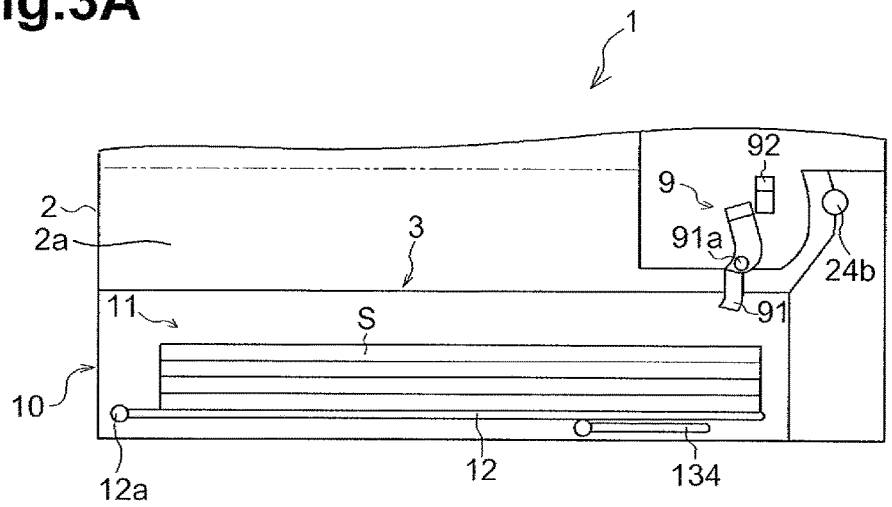
FIG. 3A is a side cross-sectional view of the image forming apparatus in which a sheet sensor detects no sheet.
Figure 3B:
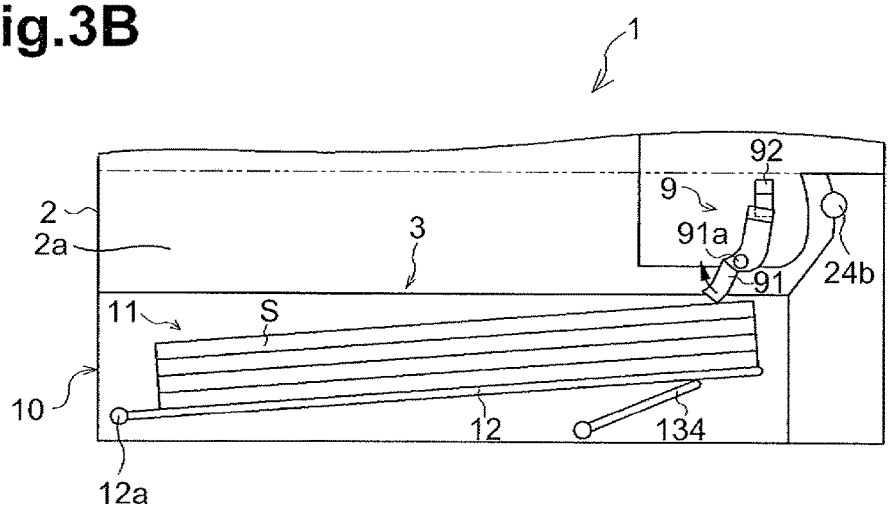
FIG. 3B is a side cross-sectional view of the image forming apparatus in which the sheet sensor detects a sheet.

As depicted in FIGS. 3A and 3B, the sheet sensor 9 includes a contact 91 and a detector 92. The contact 91 is configured to pivot by contacting a stack of the sheets S on the pressure plate 12 when the pressure plate 12 is raised to the sheet feedable position. The detector 92 is configured to detect the pivoted contact 91. This configuration may allow the sheet sensor 9 to detect a sheet S when the pressure plate 12 is raised to the sheet feedable position.

In one example, when the pressure plate 12 is at a position lower than the sheet feedable position (e.g., the lowest position), as depicted in FIG. 3A, the contact 91 does not either contact a sheet S on the pressure plate 12 or pivot, and the detector 92 does not detect the pivoting of the contact 91. Accordingly, the sheet sensor 9 does not detect a sheet S.

In contrast, when the pressure plate 12 is raised to the sheet feedable position, as depicted in FIG. 3B, the contact 91 contacts a sheet S, pivoting about a pivot 91*a*, and the detector 92 detects the pivoting of the contact 91. The sheet sensor 9 thus detects a sheet S.

When no sheet S is stacked on the pressure plate 12, e.g., the number of sheets S on the pressure plate 12 is zero (0), the sheet sensor 9 does not detect a sheet S even when the pressure plate 12 is raised to the highest position in its movable range in the up-down direction, because the contact 91 does not pivot.

Figure 7:
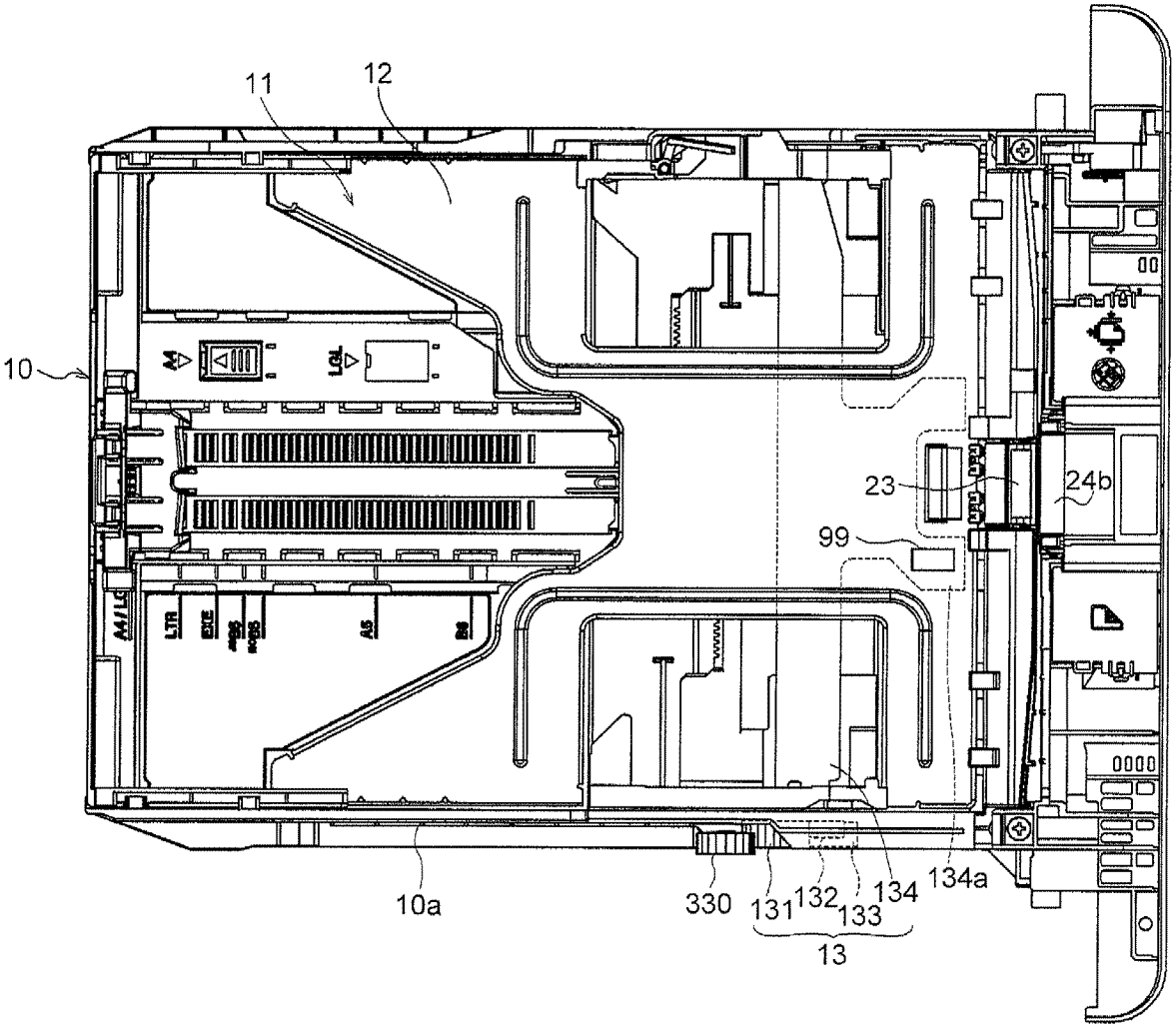
FIG. 7 is a plan view of the sheet cassette.

More specifically, as depicted in FIG. 7, the pressure plate 12 has an opening 99 therein. The opening 99 is provided at such a position to allow the contact 91 to enter the opening 99 when the pressure plate 12, which supports no sheet S, is raised to highest position in its movable range, and allow a sheet S supported by the pressure plate 12 to cover the opening 99. In this configuration, when the pressure plate 12 having no sheet S thereon, is raised to the highest position, the contact 91 entering the opening 99 may not pivot. When the pressure plate 12 supporting a sheet stack is raised to the sheet feedable position as depicted in FIG. 3B, the contact 91 contacts the top sheet S, which causes the contact 91 to pivot.

The opening 99 provided at such position in the pressure plate 12 may allow the detector 92 to detect whether the contact 91 is pivoted when the pressure plate 12 is raised.

Based on the detection of the detector 92, it may be determined whether the number of sheets S on the pressure plate 12 is zero.

The controller C is configured, for example through software instructions stored in a memory 19, to control operations of the motor 4 and the drive force transmission mechanism 30. The controller C is disposed inside the casing 2.

Figure 4:
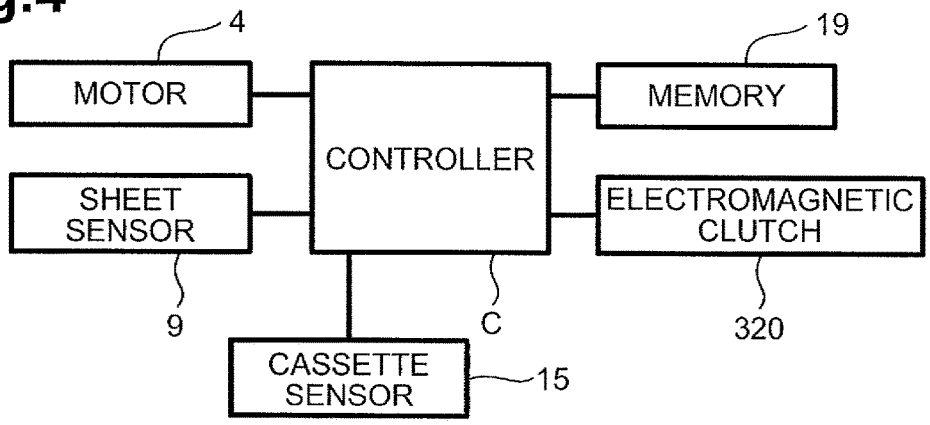
FIG. 4 is a block diagram depicting a controller, to which a motor, the sheet sensor, a memory, and an electromagnetic clutch are connected.

As depicted in FIG. 4, the controller C is connected with the motor 4, the sheet sensor 9, the cassette sensor 15, the memory 19, and an electromagnetic clutch 320 of the drive force transmission mechanism 30. The sheet sensor 9 is configured to output a signal indicating whether one or more sheets S are stacked on the pressure plate 12, to the controller C. The controller C is configured to detect the signal from the sheet sensor 9. The cassette sensor 15 is configured to output a signal indicating an open or closed state of the sheet cassette 10, to the controller C. The controller C is configured to detect the signal from the cassette sensor 15.

[Pressure Plate Raising Mechanism 13]

Next, the pressure plate raising mechanism 13 for raising the pressure plate 12 is described.

Figure 5:
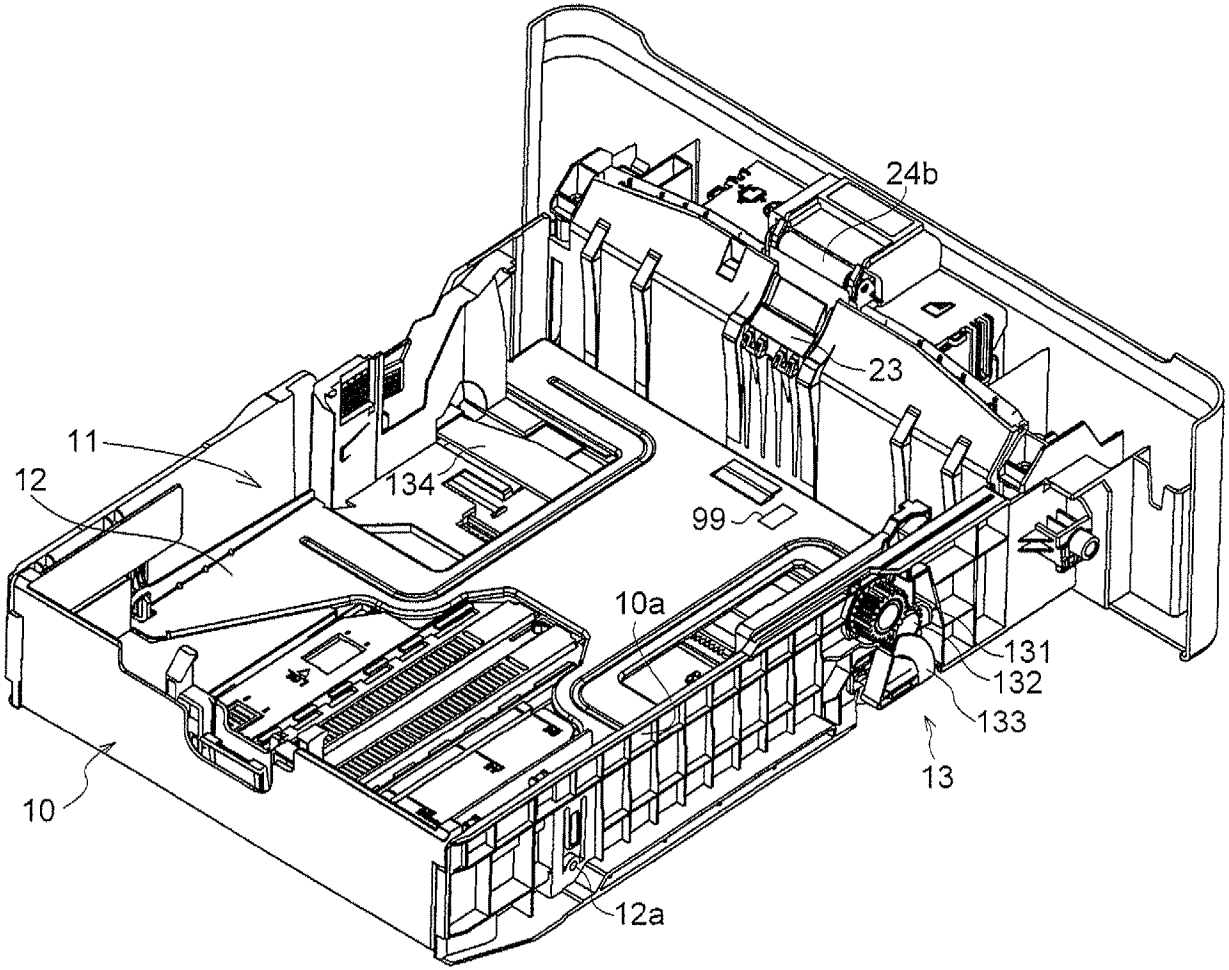
FIG. 5 is a perspective view of the sheet cassette.

As depicted in FIGS. 5-7, the pressure plate raising mechanism 13 includes a pressure plate raising gear 131, a gear 132, a gear 133, and a pressure plate raising member 134. The pressure plate raising gear 131 is configured to transmit drive force for moving the pressure plate 12 upward. The gear 132 is disposed downstream of the pressure plate raising gear 131 in a drive force transmission direction. The gear 133 is disposed downstream of the gear 132 in the drive force transmission direction. The pressure plate raising member 134 is provided for raising the pressure plate 12 and is connected to the gear 133.

The pressure plate raising gear 131 is configured to output the input drive force toward the gear 132. In other words, the gear 131 is configured to transmit the received drive force toward the gear 132. The gear 132 is engaged with the pressure plate raising gear 131 and is configured to receive the drive force from the pressure plate raising gear 131. The gear 132 is configured to output or transmit the received drive force toward the gear 133. The gear 133 is engaged with the gear 132 and is configured to receive the drive force from the gear 132. The gear 133 that has received the drive force may drive the pressure plate raising member 134.

The pressure plate raising gear 131 thus transmits the drive force, via the gears 132 and 133, and the pressure plate raising member 134, to the pressure plate 12, to raise the pressure plate 12.

The pressure plate raising member 134 is a plate-like member and extends in a direction orthogonal to the insertion/removal direction. The pressure plate raising member 134 includes a contact portion 134*a* provided at a central portion thereof in the direction orthogonal to the insertion/removal direction. The contact portion 134*a* protrudes toward the second side. The contact portion 134*a* contacts a lower surface of the pressure plate 12.

Figure 8A:
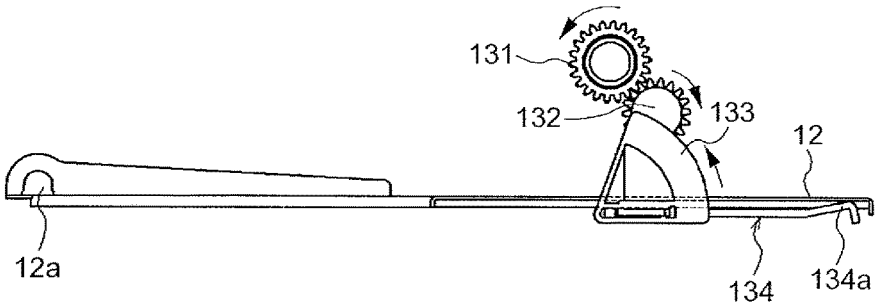
FIGS. 8A and 8B are side views depicting processes of a pressure plate being raised by a pressure plate raising mechanism.
Figure 8B:
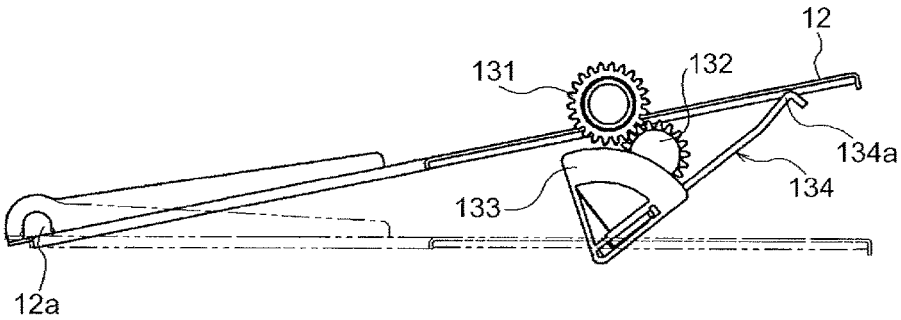

When the pressure plate 12 is at the lowest position as depicted in FIG. 8A, the pressure plate raising gear 131 may rotate counterclockwise in FIG. 8A. This rotation may cause the gear 133 to rotate counterclockwise in FIG. 8A, which may cause the contact portion 134*a* of the pressure plate raising member 134 to rise. Accordingly, the pressure plate 12 may pivot about the pivot 12*a* such that the second end of the pressure plate 12 may move upward, as depicted in FIG. 8B.

The pressure plate raising gear 131, the gear 132, and the gear 133 are attached to an outer side surface of a side wall 10*a* of the cassette 10. The side wall 10*a* is provided on one side of the cassette 10 in the direction orthogonal to the insertion/removal direction.

[Drive Force Transmission Mechanism 30]

The drive force transmission mechanism 30 is configured to transmit the drive force from the motor 4 to the pressure plate 12 via the pressure plate raising gear 131. The mechanism 30 is provided at the casing 2.

As depicted in FIG. 9, the drive force transmission mechanism 30 includes a pressure plate driving gear 330, a transmission gear train 310, and an actuator such as an electromagnetic clutch 320. The pressure plate driving gear 330 is configured to be coupled to the pressure plate raising gear 131 when the sheet cassette 10 is fully inserted into the sheet cassette receiving portion 2*a*, and to transmit the drive force from the motor 4 to the pressure plate raising gear 131 when coupled to the gear 131. When the sheet cassette 10 is not fully inserted into the sheet cassette receiving portion 2*a*, the pressure plate gear 330 is separated or disengaged from the pressure plate raising gear 131, so that the pressure plate gear 330 may not transmit the drive force to the pressure plate raising gear 131. The transmission gear train 310 is configured to transmit the drive force from the motor 4 to the pressure plate driving gear 330 therethrough. The electromagnetic clutch 320 is disposed in the transmission gear train 310 between the motor 4 and the pressure plate driving gear 330. The clutch 320 has a transmission mode and an interruption mode and is configured to be selectively changed between the modes. In the transmission mode, the clutch 320 may allow for the drive force transmission from the motor 4 to the pressure plate driving gear 330. In the interruption mode, the clutch 320 may prevent the drive force transmission from the motor 4 to the pressure plate driving gear 330.

The transmission gear train 310 includes gears 311*a* and 311*b*, gears 312*a* and 312*b*, gears 313*a* and 313*b*, a gear 314, and a gear 315. The gear 311*a* is engaged with a driving gear 4*a* provided at a driving shaft of the motor 4. The gear 311*b* is coaxial with the gear 311*a* and is configured to rotate together with the gear 311*a*. The gear 312*a* is engaged with the gear 311*b*. The gear 312*b* is coaxial with the gear 312*a* and is configured to rotate together with the gear 312*a*. The gear 313*a* is engaged with the gear 312*b*. The gear 313*b* is coaxial with the gear 313*a* and is configured to rotate together with the gear 313*a*. The gear 314 is engaged with the gear 313*b*. The gear 315 is engaged with the gear 314.

In the transmission gear train 310, the gears 311*a*, 311*b*, 312*a*, 312*b*, 313*a*, 313*b*, 314, and 315 are arranged in this order from an upstream side, e.g., motor 4 side, toward a downstream side in a drive force transmission direction. The gear 315 is coaxial with the pressure plate driving gear 330 and is configured to rotate together with the gear 330. This configuration may allow for the drive force transmission from the motor 4, via the transmission gear train 310, to the pressure plate driving gear 330.

The electromagnetic clutch 320 is disposed, for example, between the pressure plate driving gear 330 and the gear 315, which is disposed adjacent to the pressure plate driving gear 330 on the motor 4 side, e.g., upstream of the pressure plate driving gear 330 in the drive force transmission direction. The clutch 320 is configured to selectively allow the drive force between the pressure plate driving gear 330 and the gear 315 to be transmitted to the pressure plate driving gear 330.

When the electromagnetic clutch 320 is turned on and energized, the clutch 320 is placed in the interruption mode in which the drive force is not transmitted from the motor 4 to the pressure plate driving gear 330. When the electromagnetic clutch 320 is turned off and not energized, the clutch 320 is placed in the transmission mode in which the drive force is transmitted from the motor 4 to the pressure plate driving gear 330.

The pressure plate driving gear 330 is configured to receive the drive force from the motor 4 via the transmission gear train 310.

When the sheet cassette 10 is at the attached position in which the sheet cassette 10 has been attached or is fully inserted into the sheet cassette receiving portion 2*a*, the pressure plate driving gear 330 engages the pressure plate raising gear 131 of the pressure plate raising mechanism 13. This engagement may allow for the drive force transmission from the pressure plate driving gear 330 to the pressure plate raising gear 131. In other words, when the sheet cassette 10 is at the attached position, the pressure plate driving gear 330 and the pressure plate raising gear 131 are coupled to each other, allowing the drive force to be transmitted from the pressure plate driving gear 330 to the pressure plate raising gear 131.

In contrast, when the sheet cassette 10 is at the separated position in which the cassette 10 is not fully inserted and at least partially separated from the sheet cassette receiving portion 2*a*, the pressure plate driving gear 330 is separated or disengaged from the pressure plate raising gear 131, resulting in no drive force transmission to the pressure plate raising gear 131. In other words, when the sheet cassette 10 is at the separated position, the drive force is not transmitted from the pressure plate driving gear 330 to the pressure plate raising gear 131.

When the sheet cassette 10 is at the attached position and is fully inserted into the sheet cassette receiving portion 2*a*, the electromagnetic clutch 320 may be in the interruption mode. In this mode, the drive force from the motor 4 may not be transmitted to the pressure plate driving gear 330, resulting in no drive force transmission to the pressure plate raising gear 131.

When the sheet cassette 10 is at the attached position in which the sheet cassette 10 is fully inserted into the sheet cassette receiving portion 2*a*, and the clutch 320 is in the interruption mode, the pressure plate driving gear 330, the pressure plate raising gear 131 engaging with the pressure plate driving gear 330, and other gears 132 and 133 of the pressure plate raising mechanism 13 may be allowed to rotate freely. Accordingly, the pressure plate 12, which may be at a position higher than the lowest position, may move down to the lowest position, under its own weight.

[Holder]

The drive force transmission mechanism 30 may include a holder 318 for holding the pressure plate 12 at a raised position when the drive force transmission from the motor 4 to the pressure plate raising gear 131 causes the pressure plate 12 to be located at the raised position.

The holder 318 may include, for example, a one-way clutch, which may be attached to any gear of the transmission gear train 310 in the drive force transmission mechanism 30. In one example, the one-way clutch may allow a gear to which the one-way clutch is attached, to rotate in a direction to raise the pressure plate 12, but may prevent the gear from rotating in a direction to lower the pressure plate 12.

The one-way clutch may be disposed in the transmission gear train 310, on a rotation shaft of the gear 315. In this configuration, the one-way clutch may allow the gear 315 to rotate relative to the rotation shaft in the direction to raise the pressure plate 12, but may not allow the gear 315 to rotate relative to the rotation shaft in the direction to lower the pressure plate 12.

When the gear 315 having the one-way clutch attached thereto needs to be rotated in a direction to cause the pressure plate 12 to be lowered during operations of the image forming apparatus 1, restriction on the rotation of the gear 315 relative to the rotation shaft may be released. Accordingly, the gear 315 may rotate relative to the rotation shaft in the direction to lower the pressure plate 12.

[Pressure Plate Lowering Control S1]

The controller C is configured to execute pressure plate lowering control S1 in response to the power-on of the image forming apparatus 1. In the control S1, the electromagnetic clutch 320 may be placed in the interruption mode based on the sheet cassette 10 changed from the separated position to the attached position. Performing the control S1 may cause the pressure plate 12 to be lowered to the lowest position, in the sheet cassette 10, which is fully inserted into the receiving portion 2*a*.

Figure 10:
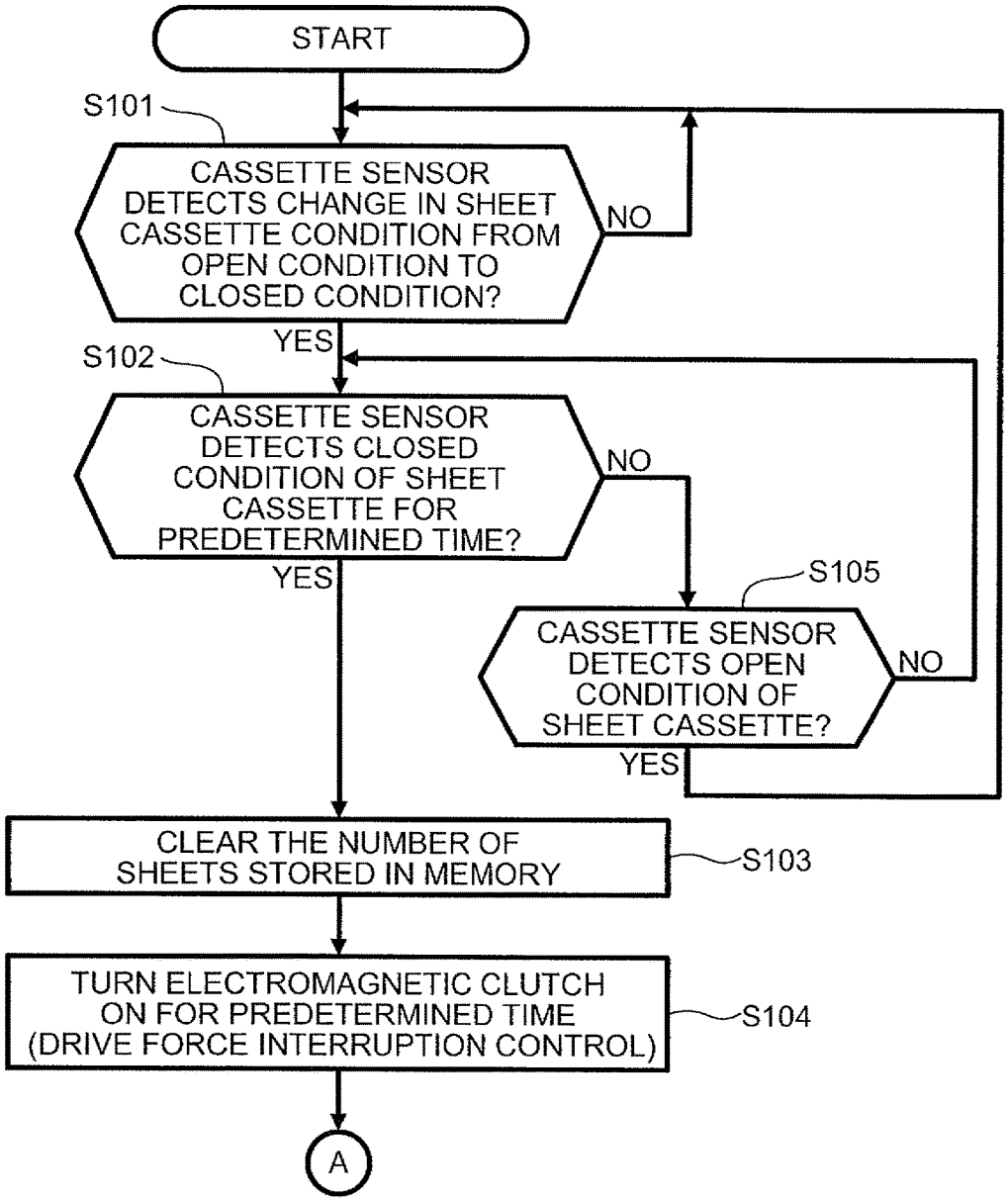
FIG. 10 is a flowchart depicting pressure plate lowering control.

In the control S1 as depicted in FIG. 10, the controller C determines a change in a detection signal from the cassette sensor 15 indicating an open or closed state of the sheet cassette 10 (S101). The detect signal may indicate the closed state of the sheet cassette 10 when it is fully inserted into the receiving portion 2*a* (e.g., at the attached position) and indicate an open state of the sheet cassette 10 when it is not fully inserted into the receiving portion 2*a* (e.g., at the separated position).

If the controller C determines a change in the detection signal indicating the state of the sheet cassette 10 from "open" to "closed," the controller C subsequently determines the detection signal indicating the closed state continues for a predetermined time. In other words, the controller C determines whether the sheet cassette 10 is closed for the predetermined time, for example, approximately 100 ms (S102).

When the controller C determines no change in the detection signal from "open" to "closed" in S101, the controller C repeats the determination in step S101 until a change in the detection signal occurs.

In step S102, if the controller C determines no change in the detection signal indicating the closed state for the predetermined time, the controller C deletes or clears the number of sheets stored in the memory 19 (S103). The controller C executes a drive force interruption control (S104). In S104, the controller C controls the electromagnetic clutch 320 to turn on into the interruption mode.

As the electromagnetic clutch 320 is placed in the interruption mode, the drive force from the motor 4 is not transmitted to the pressure plate driving gear 330. This may allow the pressure plate 12, which may be located at a position higher than the lowest position, to move downward to the lowest position.

The interruption mode of the electromagnetic clutch 320 is maintained for a predetermined particular time, for example, approximately 30 ms. The predetermined particular time may preferably be longer than or equal to, for example, a time required for the pressure plate 12 to move from a possible highest position to the lowest position in its movable range in the up-down direction. The possible highest position is a position where the pressure plate 12 may be expected to rise at the highest when the sheet cassette 10 is fully inserted into the sheet cassette receiving portion 2*a* and the pressure plate raising gear 131 engages in phase with the pressure plate driving gear 330. The gear 131, when engaged with the gear 330, may be rotated slightly (e.g., for a few or several teeth) to be in phase with the gear 330. This slight rotation may cause the pressure plate 12 to rise from the lowest position to a position not higher than the possible highest position. In another example, the predetermined particular time may be shorter than the time required for the pressure plate 12 to move from the possible highest position to the lowest position in its movable range in the up-down direction.

If the controller C determines in step S102 that the detecting signal indicating the closed state of the sheet cassette 10 does not continue for the predetermined time, the controller C further determines whether a detection signal indicating the state of the sheet cassette 10 is changed from "closed" to "open" (S105).

In step S105, if the controller C determines a change in the detection signal indicating the state of the sheet cassette 10 to "open", flow returns to step S101. If the controller C determines no change in the detection signal indicating the closed state of the sheet cassette 10, flow returns to step S102.

When the sheet cassette 10 is closed (e.g., moved to the attached position), the pressure plate raising gear 131 may rotate in a direction to move the pressure plate 12 to a raised position higher than its lowest position. By controlling the electromagnetic clutch 320 such that its mode is placed in the interruption mode after the sheet cassette 10 is closed, the pressure plate 12 at the raised position may be lowered to the lowest position.

[Sheet Calculation Control S2]

The controller C is configured to execute the pressure plate lowering control 51 to lower the pressure plate 12 to the lowest position. Subsequently, the controller C may execute sheet calculation control S2 in which the number of sheets S stacked on the sheet cassette 10 may be calculated by raising the pressure plate 12.

Figure 11:
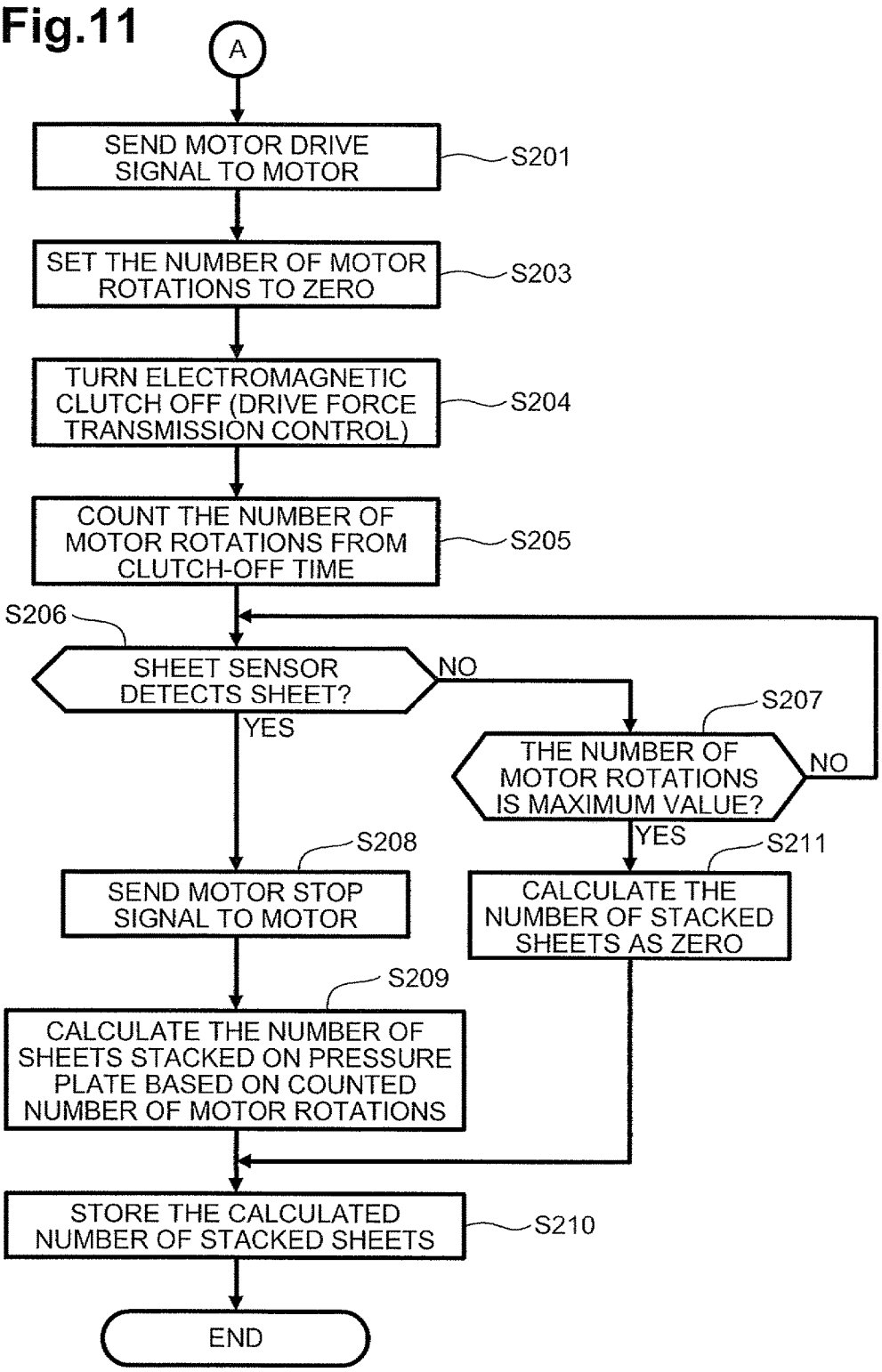
FIG. 11 is a flowchart depicting sheet calculation control.

In the control S2 as depicted in FIG. 11, the controller C sends a motor drive signal to the motor 4 to drive the motor 4 (S201).

The controller C sets the number of rotations of the motor 4 (motor rotations) to zero (0) (S203).

Subsequently, the controller C executes a drive force transmission control in which the electromagnetic clutch 320 is turned off into the transmission mode (S204).

The drive force transmission control may be performed at least the particular time after the electromagnetic clutch 320 is placed in the interruption mode by the pressure plate lowering control S1, as described above. The particular time may be a period of time required for the pressure plate 12, which has been raised at the possible highest position in the movable range in the up-down direction, to lower to the lowest position.

In one example, the interruption mode of the electromagnetic clutch 320 may be maintained preferably (but not limited to) at least until the pressure plate 12 is lowered to the lowest position. The drive force transmission control for changing or switching the clutch 320 to the transmission mode may be performed, but not limited to, after the pressure plate 12 has been lowered to the lowest position.

Switching the electromagnetic clutch 320 to the transmission mode causes the drive force from the motor 4 to be transmitted to the pressure plate raising mechanism 13. This drive force transmission causes the pressure plate 12 to start rising.

The controller C counts the number of motor rotations from a clutch-off time, e.g., a time when the electromagnetic clutch 320 is switched to the transmission mode. (S205).

Subsequent to the drive force transmission control, a pressure plate raising control may start. Under the pressure plate raising control, the pressure plate 12 may be raised by the drive force of the motor 4 and the number of motor rotations may be counted from the clutch-off time.

After starting the pressure plate raising control, the controller C determines whether a detection signal from the sheet sensor 9 indicating a state of the contact 91 of the sheet sensor 9 is changed from "unpivoted" to "pivoted" (S206). The contact 91 may pivot when it contacts a sheet S on the pressure plate 12 during the rising of the pressure plate 12. If the controller C determines no change in the detection signal from the sheet sensor 9, the controller C determines whether the number of motor rotations is a maximum value (S207).

If the controller C determines that the number of motor rotations is not the maximum value, flow returns to step S206 where the controller C again determines a change in the detection signal from "unpivoted" to "pivoted". If the controller C determines no change in the detection signal in S206, flow proceeds to step S207 where the controller C again determines whether the number of motor rotations is the maximum value.

If the controller C determines a change in the detection signal from "unpivoted" to "pivoted" in S206 during the motor rotation counting, the controller C sends a motor stop signal to the motor 4 (S208). The controller C calculates the number of the sheets S on the pressure plate 12, based on the number of motor rotations counted from a time when the clutch 320 is turned off to when the detection signal indicating a state of the contact 91 is changed to "pivoted" (S209).

The number of sheets S stacked on the pressure plate 12 may be calculated by the following manner. For example, the obtained number of motor rotations is subtracted from the number of motor rotations required to raise the pressure plate 12 from the lowest position to the highest position in its movable range. The obtained difference may be multiplied by a conversion factor to convert the number of motor rotations to the number of the sheets S on the pressure plate 12.

The conversion factor may represent the relationship between the number of motor rotations required to raise the pressure plate 12 by a predetermined dimension or distance and the number of sheets S required to make a stack having the predetermined dimension or thickness.

The controller C determines the calculated number of the stacked sheets S as the number of sheets S remaining in the sheet cassette 10. The controller C stores the number of sheets S remaining in the sheet cassette 10 in the memory 19 (S210). The controller C ends the sheet calculation control S2.

In the controls of steps S206 and S207, the controller C may determine no change in the detection signal from the sheet sensor 9 indicating the state of the contact 91 is changed from "unpivoted" to "pivoted," and that the number of motor rotations reaches the maximum value. In this case, the pressure plate 12 has been raised to the highest position in its movable range but no sheet S contacts the contact 91. Accordingly, the controller C determines that no sheet S is on the pressure plate 12, e.g., calculates the number of stacked sheets S as zero (S211).

Subsequent to the calculation in step S211, the controller C stores in the memory 19 the calculation results, e.g., zero (0), as the number of stacked sheet S (S210). The controller C ends the sheet calculation control S2.

Another Embodiment of Sheet Calculation Control S2

In the sheet calculation control S2 according to the above-described illustrative embodiment, the number of sheets S is calculated using the number of motor rotations counted from the clutch-off time. In another embodiment, the number of sheets S may be calculated using the time elapsed from the clutch-off time.

In another embodiment, the controller C may measure the time elapsed from the clutch-off time in step S205.

In step S207, the controller C determines whether the time elapsed from the clutch-off time reaches a predetermined setting value.

If the controller C determines that a detection signal from the sheet sensor 9 indicating the state of the contact 91 is changed from "unpivoted" to "pivoted," the controller C calculates the number of the sheets S stacked on the pressure plate 12 based on the time elapsed from a time when the clutch 320 is turned off to when the detection signal is changed to "pivoted"(S209).

In this case, the number of sheets S stacked on the pressure plate 12 may be calculated by the following manner. For example, the obtained elapsed time is subtracted from the time required to raise the pressure plate 12 from the lowest position to the highest position in its movable range. The obtained difference may be multiplied by a conversion factor to convert the elapsed time to the number of the sheets S on the pressure plate 12.

The conversion factor may represent the relationship between the motor rotating time required to raise the pressure plate 12 by a predetermined dimension or distance and the number of sheets S required to make a stack having the predetermined dimension or thickness.

In controls of steps S206 and S207, the controller C may determine no change in the detection signal from the sheet sensor 9 indicating the state of the contact 91 is changed from "unpivoted" to "pivoted," and that the elapsed time from the clutch-off time reaches the predetermined setting value (S207). In this case, the pressure plate 12 has been raised to the highest position in its movable range but no sheet S contacts the contact 91. Accordingly, the controller C determines that no sheet S is on the pressure plate 12, e.g., calculates the number of stacked sheets S as zero (S211).

In the sheet calculation control S2 according to the another embodiment, the number of sheets S is thus calculated using the time elapsed from the clutch-off time.

[Execution Timing of Drive Force Interruption Control And Sheet Calculation Control S2]

In the illustrative embodiment, based on the sheet cassette 10 changed from the separated position to the attached position (e.g., change in the detection signal from the cassette sensor 15 from "open" to "closed"), the controller C sequentially executes the drive force interruption control (S104) of the pressure plate lowering control 51 and the sheet calculation control S2, to calculate the number of the sheets S stacked on the pressure plate 12. The time when those controls are executed is not limited to this specific time but may be executed at any time.

For example, the drive force interruption control (S104) of the pressure plate lowering control 51, and the sheet calculation control S2 may be sequentially executed after the sheet cassette 10 is changed from the separated position to the attached position and an image forming or printing is performed.

[Repeated Clutch Mode Change Control S3]

The controller C may be configured to perform repeated clutch mode change control S3 for repeatedly and selectively changing the mode of the electromagnetic clutch 320 between the interruption mode and the transmission mode, for the drive force interruption control in S104. In the control S3, the electromagnetic clutch 320 is repeatedly changed between the interruption mode and the transmission mode for a predetermined period of time, and is changed back to the interruption mode at the end of the control S3.

In other words, instead of the control 51 in which the electromagnetic clutch 320 is maintained in the interruption mode for the predetermined time to continuously lower the raised pressure plate 12 to the lowest position at one time, the control S3 may be performed in which the clutch 320 is repeatedly changed between the interruption mode and the transmission mode to lower the raised pressure plate 12 to the lowest position intermittently.

Figure 12:
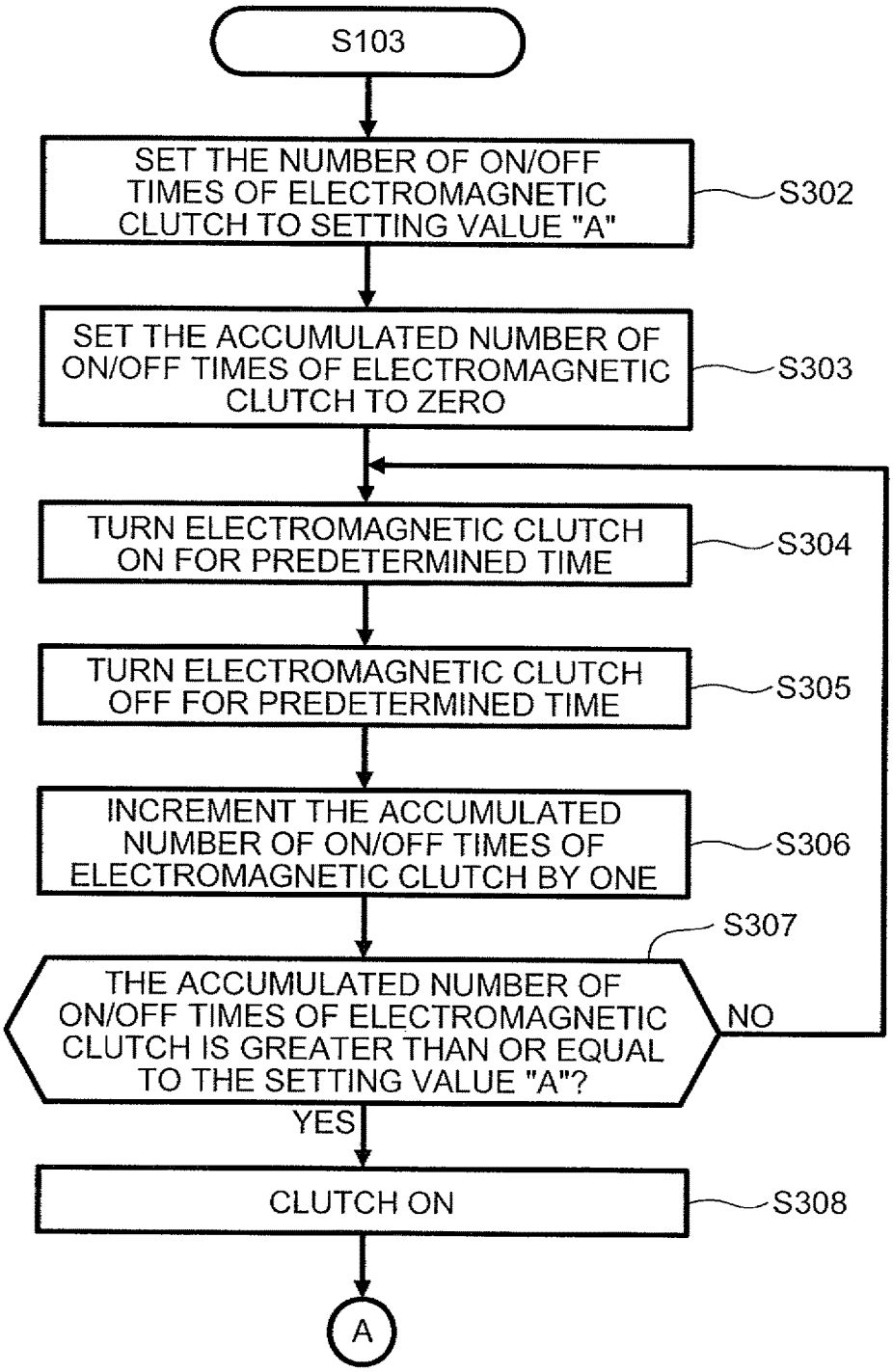
FIG. 12 is a flowchart depicting repeated clutch mode change control.
Figure 13:
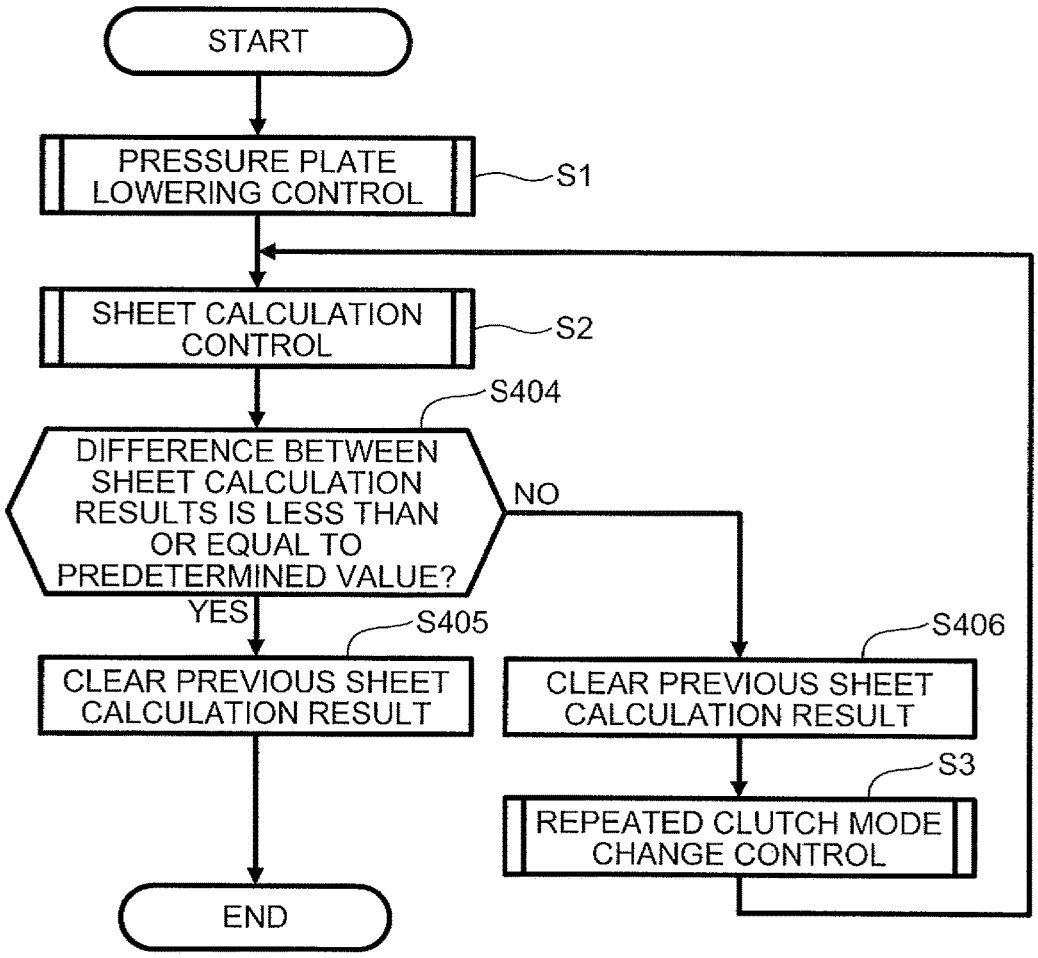
FIG. 13 is a flowchart depicting repeated sheet calculation control.

In the control S3 as depicted in FIG. 12, the controller C first sets the number of on/off times of the electromagnetic clutch 320 for lowering the pressure plate 12 to the lowest position, to a setting value A (S302). In the illustrative embodiment, the setting value A may be, for example, "11."

Subsequent to setting the number of on/off times to the setting value A, the controller C sets the accumulated number of on/off times of the electromagnetic clutch 320 to zero (S303).

Subsequently, the controller C controls the electromagnetic clutch 320 to be turned on into the interruption mode for a predetermined time, e.g., 30 ms (S304). During that time, the pressure plate 12 may be lowered from a raised position by its own weight.

The predetermined time period in which the electromagnetic clutch 320 is turned on may be determined based on, for example, a dimension or height difference between the highest position and the lowest position of the pressure plate 12 and the setting value A.

After the clutch 320 is turned on for the predetermined time, the controller C controls the clutch 320 to be turned off into the transmission mode for a predetermined time (S305). As the electromagnetic clutch 320 is switched into the transmission mode, the pressure plate raising gear 131 is prevented from freely rotating. Accordingly, the pressure plate 12 may stop lowering.

The predetermined time in which the electromagnetic clutch 320 is turned off may be set to such a time that is sufficient for, for example, the clutch 320, to absorb lowering energy of the pressure plate 12 when the pressure plate 12 stops lowering.

Subsequent to turning the electromagnetic clutch 320 on and off in steps S304 and S305, respectively, the controller C increments the accumulated number of on/off times of the electromagnetic clutch 320 by one (S306). Subsequently, the controller C determines whether the accumulated number of on/off times of the electromagnetic clutch 320 is greater than or equal to the setting value A (S307).

If the controller C determines that the accumulated number of on/off times of the electromagnetic clutch 320 is not greater than or equal to the setting value A, flow returns to step S304 in which the controller C controls the electromagnetic clutch 320 to be turned on for the predetermined time. In step S305, the controller C controls the electromagnetic clutch 320 to be turned off for the predetermined time. In step S306, the controller C increments the accumulated number of on/off times of the electromagnetic clutch 320 by one. Subsequently, in step S307, the controller C determines whether the accumulated number of on/off times of the electromagnetic clutch 320 is greater than or equal to the setting value A.

The electromagnetic clutch 320 is thus repeatedly turned on and off. As the accumulated number of on/off times of the electromagnetic clutch 320 reaches the setting value A, the controller C determines that the accumulated number of on/off times of the electromagnetic clutch 320 is greater than or equal to the setting value A in step S307. Subsequently, the controller C controls the clutch 320 to turn on in S308. The controller C ends the control S3.

Execution of the control S3 may cause the pressure plate 12, which is located at a raised position, to be lowered intermittently. This may reduce the lowering amount of the pressure plate 12 by one interruption mode. The pressure plate 12 may be lowered to the lowest position intermittently by a small amount or distance at a time.

[Repeated Sheet Calculation Control S4]

The controller C may execute repeated sheet calculation control S4 for repeatedly calculating the number of sheets S in the sheet cassette 10. In the control S4, the sheet calculation control S2 may be performed plural times.

In the control S4, the controller C first executes the control S1 in response to the power-on of the image forming apparatus 1, and then the control S2. In other words, based on the sheet cassette 10 changed from the separated position to the attached position, the pressure plate 12 is lowered to the lowest position by the drive force interruption control (S104). Subsequently, the number of sheets S in the sheet cassette 10 is calculated by the control S2.

Subsequent to the execution of the controls S1 and S2, the controller C determines whether a difference between sheet calculation results obtained by the previous (e.g., last) control S2 and the current control S2 is less than or equal to a predetermined value (S404).

In step S404, if the controller C determines that the difference in the sheet calculation results is not less than or equal to the predetermined value, the controller C clears or deletes the previous sheet calculation result from the memory 19 (S406). Subsequently, the controller C executes the control S3 (e.g., S302-S308) in which the electromagnetic clutch 320 is switched selectively and repeatedly between the interruption mode and the transmission mode. Execution of the control S3 may cause the pressure plate 12, which is raised to the sheet feedable position, to be lowered to the lowest position.

In a case where the previous sheet calculation result is not stored in the memory 19, the controller C determines the difference in the sheet calculation results is not less than or equal to the predetermined value.

Subsequent to the control S3, the controller C executes the control S2 again.

In step S404, if the controller C determines that the difference in the sheet calculation results is less than or equal to the predetermined value, the controller C clears or deletes the previous sheet calculation result from the memory 19, to remain the current sheet calculation result in the memory 19 (S405). The controller C ends the control S4.

The sheet calculation control S2 may be executed repeatedly until the difference between the previous sheet calculation result and the current sheet calculation result becomes less than or equal to the predetermined value. Thus, the number of sheet S in the sheet cassette 10 may be calculated with high accuracy.

In the illustrative embodiment, subsequent to the determination in step S404 that difference in the sheet calculation results is not less than or equal to the predetermined value and the deletion of the previous sheet calculation result in S406, the controller C executes the control S3 in which the clutch 320 is switched selectively and repeatedly between the interruption mode and the transmission mode. Alternatively, the drive force interruption control (S104) may be executed instead of the control S3. In this configuration, a time in which the clutch 320 is turned on into the interruption mode may be preferably be longer than or equal to, for example, a time required for the pressure plate 12 to move from the highest position to the lowest position in its movable range in the up-down direction. Such time may be, for example, approximately 100 ms.

In the illustrative embodiment, the number of sheet S in the sheet cassete 10 is determined besed on the two calculation results (e.g., the previous sheet calculation result and the current sheet calculation result). Nevertheless, in other embodiments, for example, the number of sheet S in the sheet cassete 10 may be determined besed on the three or more calculation results.

[Effects of Illustrative Embodiment]

In the illustrative embodiment, the image forming apparatus 1 is configured to execute the pressure plate lowering control S1, based on the controller C determining that a detection signal from the cassette sensor 15 indicating the state of the sheet cassette 10 is changed from "open" to "closed". In the control S1, the electromagnetic clutch 320 may be placed in the interruption mode in which the drive force from the motor 4 is not transmitted to the pressure plate driving gear 330.

In the image forming apparatus 1, as the sheet cassette 10 is fully inserted into the sheet cassette receiving portion 2*a*, the pressure plate raising gear 131 engages the pressure plate driving gear 330. At this time, the gear 131 may be rotated slightly (e.g., for one or a few teeth) to be in phase with the pressure plate driving gear 330. This slight rotation may cause the pressure plate 12 to rise from the lowest position. In such case, execution of the pressure plate lowering control S1 may cause the pressure plate 12 at a raised position to be lowered to the lowest position reliably.

This configuration may enable the number of sheets S stacked on the pressure plate 12 to be calculated with high accuracy because the pressure plate 12 may be lowered to the lowest position reliably after the sheet cassette 10 has been attached to the casing 2.

The electromagnetic clutch 320 is configured to selectively allow the drive force between the pressure plate driving gear 330 and the gear 315, which is disposed adjacent to the pressure plate driving gear 330 on the motor 4 side, e.g., upstream of the pressure plate driving gear 330 in the drive force transmission direction, to be transmitted to the gear 330.

This configuration may allow the pressure plate 12 to be lowered smoothly and reliably to the lowest position with fewer gears between the electromagnetic clutch 320 and the pressure plate 12.

The drive force transmission mechanism 30 may include the holder 318, e.g., a one-way clutch, that holds the pressure plate 12 at a raised position above the lowest position.

This configuration may allow the pressure plate 12 to be held, with no drive force, at a raised position, e.g., the sheet feedable position at which a sheet S may be fed from a stack thereof.

The image forming apparatus 1 is configured to execute the pressure plate lowering control S1 in which the electromagnetic clutch 320 may be maintained in the interruption mode until the pressure plate 12 is lowered to the lowest position. Subsequently, the image forming apparatus 1 may execute the sheet calculation control S2. In the control S2, the number of motor rotations may be counted from the time when the clutch 320 is turned off (e.g., clutch-off time) until the contact 91 of the sheet sensor 9 contacts a sheet S and thereby pivots. Based on the number of counted motor rotations, the number of sheets S stacked on the pressure plate 12 may be calculated.

This configuration may allow the number of motor rotations to be counted after the pressure plate 12 has been lowered to the lowest position, for the calculation of the number of the sheets S stacked on the pressure plate 12. The number of the sheets S may thus be calculated with high accuracy.

In the control S2, an elapsed time may be measured from a time when the clutch 320 is turned off until the contact 91 of the sheet sensor 9 contacts a sheet S and thereby pivots. Based on the measured elapsed time, the number of sheets S stacked on the pressure plate 12 may be calculated.

This configuration may allow the elapsed time to be measured after the pressure plate 12 has been lowered to the lowest position, for the calculation of the number of the sheets S stacked on the pressure plate 12. The number of the sheets S may thus be calculated with high accuracy.

The controller C is configured to calculate the number of sheets S stacked on the pressure plate 12 as zero when the pressure plate 12 is raised to the sheet feedable position and the contact 91 of the sheet sensor 9 does not contact any sheet S in the sheet calculation control S2.

In one example, when the number of motor rotations counted from the clutch-off time has reached the predetermined value, the controller C may determine that the detection signal from the sheet sensor 9 indicating the state of the contact 91 is not changed from "unpivoted" to "pivoted." In this case, the controller C is configured to calculate the number of the sheets S stacked on the pressure plate S as zero.

Accordingly, if no sheet S is stacked on the pressure plate 12, the controller C may determine that the number of the sheets S stacked on the pressure plate S as zero.

In the image forming apparatus 1, the controller C may sequentially execute, at any timing, the pressure plate lowering control S1, and the sheet calculation control S2, to calculate the number of sheets S stacked on the pressure plate 12.

This configuration may allow the number of stacked sheets S to be calculated when necessary, for example, when a considerable time has elapsed since the sheet calculation control S2 is executed last time and there is a discrepancy between the number of stacked sheets S that the image forming apparatus 1 grasps and the actual number of stacked sheets S.

The image forming apparatus 1 may allow the controller C to execute the repeated clutch mode change control S3 for the control S1. In the control S3, the electromagnetic clutch 320 may be selectively switched between the interruption mode and the transmission mode for the predetermined time. Such mode change or switch may be repeated plural times. At the end of the control S3, the clutch 320 may be switched back to interruption mode.

This configuration may reduce a lowering amount that the pressure plate 12 is lowered from a raised position at one time (e.g., by one interruption mode). This may reduce a lowering speed of the pressure plate 12, as compared with a case in which the pressure plate 12 is lowered from a raised position to the lowest position at one time (e.g., by one interruption mode) without pausing. Accordingly, noises caused when the pressure plate 12 is lowered may be reduced.

The image forming apparatus 1 may allow the controller C to execute repeated sheet calculation control S4 to calculate the number of sheets S stacked on the pressure plate 12. In the control S4, the sheet calculation control S2 may be repeated or executed plural times until the difference between sheet calculation results obtained by the previous control S2 and the current control S2 becomes less than or equal to the predetermined value.

This configuration may allow the number of stacked sheets S to be calculated with high accuracy.

What is claimed is:

1. A printer, comprising:

a casing;

a print mechanism disposed inside the casing;

a motor;

a sheet cassette having an attached position in which the sheet cassette is supported by the casing and a separated position in which the sheet cassette is at least partially separated from the casing, the sheet cassette including a movable sheet support plate configured to support a sheet stack including one or more sheets;

an actuator having a transmission mode in which the drive force is allowed to be transmitted from the motor to the sheet support plate to move the sheet support plate, and an interruption mode in which the drive force is prevented from being transmitted from the motor to the sheet support plate and the sheet support plate can move to a lowest position under its own weight, the actuator configured to be selectively placed in one of the transmission mode and the interruption mode; and a controller configured to selectively place the actuator into the transmission mode and the interruption mode, and wherein the controller is configured to place the actuator into the interruption mode in response to the sheet cassette being placed in the attached position.

2. The printer according to claim 1, wherein the actuator comprises a clutch.

3. The printer according to claim 1, wherein:

the sheet cassette further comprises a raising gear engaging the sheet support plate and configured, when the sheet cassette is in the separated position, to be rotated by the weight of the sheet support plate in a direction to lower the sheet support plate, the raising gear configured, when receiving the drive force from the motor, to be rotated by the drive force from the motor in a direction to raise the sheet support plate;

the printer further comprises a driving gear configured to be rotated by the drive force from the motor, the driving gear engaging with the raising gear when the sheet cassette is in the attached position and disengaged from the raising gear when the sheet cassette is in the separated position.

4. The printer according to claim 3, further comprising:

a first gear configured to be rotated by the drive force from the motor;

a second gear configured to be rotated by the drive force from the motor, the second gear configured to receive a rotating force of the first gear; and a transmission member configured to transmit a rotating force of the second gear to the driving gear, the transmission member including the actuator, wherein the actuator comprises a clutch.

5. The printer according to claim 4, further comprising a one-way clutch configured to prevent one of the first gear and the second gear from rotating in a direction to lower the sheet support plate.

6. A printer, comprising:

a casing;

a print mechanism disposed inside the casing;

a motor;

a sheet cassette having an attached position in which the sheet cassette is supported by the casing and a separated position in which the sheet cassette is at least partially separated from the casing, the sheet cassette including a movable sheet support plate configured to support a sheet stack including one or more sheets;

an actuator having a transmission mode in which the drive force is allowed to be transmitted from the motor to the sheet support plate to move the sheet support plate, and an interruption mode in which the drive force is prevented from being transmitted from the motor to the sheet support plate, the actuator configured to be selectively placed in one of the transmission mode and the interruption mode; and a controller configured to selectively place the actuator into the transmission mode and the interruption mode, wherein the controller is configured to place the actuator into the interruption mode in response to the sheet cassette being placed in the attached position.

7. The printer according to claim 6, further comprising a cassette sensor configured to output a first signal when the sheet cassette is in the attached position and a second signal when the sheet cassette is in the separated position.

8. The printer according to claim 7, wherein the controller is configured to place the actuator in the interruption mode in response to receiving the first signal from the cassette sensor.

9. The printer according to claim 7, wherein the controller is configured to place the actuator in the interruption mode in response to the cassette sensor continuously outputting the first signal, for a predetermined time.

10. The printer according to claim 7, wherein the controller is configured to place the actuator in the interruption mode in response to the cassette sensor outputting the first signal and after printing a predetermined number of sheets.

11. A printer, comprising:

a casing;

a print mechanism disposed inside the casing;

a motor;

a sheet cassette having an attached position in which the sheet cassette is supported by the casing and a separated position in which the sheet cassette is at least partially separated from the casing, the sheet cassette including a movable sheet support plate configured to support a sheet stack including one or more sheets;

an actuator having a transmission mode in which the drive force is allowed to be transmitted from the motor to the sheet support plate to move the sheet support plate, and an interruption mode in which the drive force is prevented from being transmitted from the motor to the sheet support plate, the actuator configured to be selectively placed in one of the transmission mode and the interruption mode;

a sheet sensor configured to output a third signal when the sheet stack contacts a pick-up roller and a fourth signal when the sheet stack does not contact the pick-up roller, and a controller configured to:

selectively place the actuator into the transmission mode and the interruption mode subsequent to placing the actuator in the interruption mode, place the actuator in the transmission mode at a first time; and thereafter in response to receiving the third signal output by the sheet sensor at a second time, calculate a first amount of the sheets stacked on the sheet support plate based on an operation parameter of the motor.

12. The printer according to claim 11, wherein the controller is configured to place the actuator in the interruption mode for a predetermined time period before placing the actuator in the transmission mode at the first time.

13. The printer according to claim 12, wherein the predetermined time period is shorter than a time required for the sheet support plate to move from a position where the sheet support plate contacts the pick-up roller to a lowest position where the sheet support plate is adjacent a floor of the sheet cassette.

14. The printer according to claim 11, wherein the controller is configured to calculate the first amount of the sheets stacked on the sheet support plate based on the operation parameter of the motor between the first time and the second time.

15. The printer according to claim 14, wherein the controller is configured to, subsequent to driving the motor, place the actuator in the transmission mode at the first time.

16. The printer according to claim 11, wherein the controller is configured to:

store the calculated first amount of sheets in a memory;

place the actuator in the interruption mode at a third time;

place the actuator in the transmission mode at a fourth time; and thereafter in response to receiving the third signal output by the sheet sensor, calculate a second amount of the sheets stacked on the sheet support plate based on an operation parameter of the motor; and compare the calculated first amount of sheets to the calculated second amount of sheets.

17. The printer according to claim 16, wherein the controller is configured to place the actuator in the interruption mode for a predetermined time period before placing the actuator in the transmission mode at the fourth time, wherein the predetermined time period is longer than or equal to a time required for the sheet support plate to move from a position where the sheet support plate contacts the pick-up roller to a lowest position where the sheet support plate is adjacent a floor of the sheet cassette.

18. The printer according to claim 16, wherein the controller is configured to:

subsequent to placing the actuator in the interruption mode for a predetermined time period at the third time, place the actuator in the transmission mode;

place the actuator in the interruption mode for the predetermined time period at a fifth time; and thereafter place the actuator in the transmission mode at the fourth time; and wherein the predetermined time period is shorter than a time required for the sheet support plate to move from a position where the sheet support plate contacts the pick-up roller to a lowest position where the sheet support plate is adjacent a floor of the sheet cassette.

19. The printer according to claim 16, wherein when a difference between the calculated first amount of sheets and the calculated second amount of sheets is less than or equal to a predetermined amount, the controller determines that a sheet amount stacked on the sheet support plate corresponds to the calculated second amount of sheets.

20. The printer according to claim 19, wherein when the difference between the calculated first amount of sheets and the calculated second amount of sheets is greater than the predetermined amount, the controller is configured to:

alternately place the actuator in the interruption mode and the transmission mode a predetermined number of times; and thereafter, place the actuator in the transmission mode; and in response to receiving the third signal output by the sheet sensor, calculate a third amount of the sheets stacked on the sheet support plate based on an operation parameter of the motor.

21. The printer according to claim 11, wherein the controller is configured to determine that the sheet support plate supports no sheet if the third signal is not received within a predetermined operation parameter of the motor.

22. The printer according to claim 11, wherein the operation parameter of the motor includes a number of rotations of the motor.

23. The printer according to claim 11, wherein the operation parameter of the motor includes a driving time of the motor.

24. The printer according to claim 11, wherein the controller is configured to calculate the number of sheets stacked on the sheet support plate using a thickness of one sheet.

* * * * *